United States Patent [19]

Herbstman

[11] 4,125,455

[45] Nov. 14, 1978

[54] HYDROTREATING HEAVY RESIDUAL OILS

[75] Inventor: Sheldon Herbstman, Spring Valley, N.Y.

[73] Assignee: Texaco Inc., New York, N.Y.

[21] Appl. No.: 816,417

[22] Filed: Jul. 13, 1977

Related U.S. Application Data

[63] Continuation of Ser. No. 400,866, Sep. 26, 1973, abandoned.

[51] Int. Cl.[2] ..... C10G 13/06; B01J 27/04

[52] U.S. Cl. ..... 208/108; 208/89; 208/97; 208/112; 208/212; 208/215; 208/216; 252/431 C; 252/439; 252/467

[58] Field of Search ..... 208/108, 112, 215, 216, 208/89, 97, 212; 252/431 C, 467

[56] References Cited

U.S. PATENT DOCUMENTS

| | | | |
|---|---|---|---|
| 2,091,831 | 8/1937 | Pongratz et al. | 208/108 |
| 3,131,142 | 4/1964 | Mills | 208/108 |
| 3,502,564 | 3/1970 | Hodgson | 208/9 |

OTHER PUBLICATIONS

Bureau of Mines Bulletin 622 (1965) pp. 26–28.

*Primary Examiner*—Delbert E. Gantz
*Assistant Examiner*—G. E. Schmitkons
*Attorney, Agent, or Firm*—Thomas H. Whaley; Carl G. Ries; William E. McNulty

[57] ABSTRACT

Low concentrations of Group VIB metal salts of fatty acids will catalyze the hydroconversion of sulfur-containing heavy petroleum oils producing a lighter oil fraction having a lower sulfur concentration than the heavy oil and a tar fraction containing a higher sulfur concentration than the heavy oil. Catalyst concentrations of 300 to 1,000 ppm, calculated as the elemental metal, are used. Molybdenum octoate is a preferred catalyst.

11 Claims, No Drawings

HYDROTREATING HEAVY RESIDUAL OILS

This is a continuation, of application Ser. No. 400,866, filed Sept. 26, 1973, and now abandoned.

BACKGROUND OF THE INVENTION

This invention relates to the hydroconversion of heavy petroleum oil and, in particular, is directed to the use of a soluble or dispersible metal salt of a fatty acid to catalyze the hydroconversion of sulfur-containing high-boiling petroleum oils.

The use of homogeneous catalysts is well known. Further, the use, per se, of metal-containing organic compounds to catalyze hydrocarbon conversions is also well known and such materials have been used to effect coversion of higher boiling fractions to lower boiling products, as well as to effect the reduction of sulfur and/or nitrogen and other contaminants in petroleum fractions. Thus, for example, U.S. Pat. No. 1,876,270 of Zorn discloses the destructive hydrogenation (also knwon as hydrocracking) of such hydrocarbon mixtures as gas oils through the use of Group III to VII metal salts of 1,3 diketones. These metal salts are coordinated compounds which decompose under the reaction conditions producing the metal in a free state which acts as a catalyst. Metal salt concentrations of above 3.5 wt. % (based on the metal salt compound) are found effective. U.S. Pat. No. 2,091,831 of Pongratz et al discloses the hydroconversion of hydrocarbon mixtures with Group IV or VIII metal salts of naphthenic, oleic or stearic acids. Such hydrocarbon mixtures as tars, residuum and bitumens are said to be converted to more useful products under hydrocracking conditions which include temperatures of 300° to 700° C. These metal salts do not decompose but act as true catalysts when added in concentrations of 4 to 20 wt. %, based on the salt (or about 1 to 3%, based on the metal). U.S. Pat. No. 3,131,142 of Mills discloses the use of metal salts of carboxylic, phenolic or naphthenic acids for the hydrocracking of such heavy oils as topped crude, gas oils, cycle oils, residuum, tars, etc. Salts of the Group II to VIII metals are disclosed and useful concentrations of 0.1 to 1 wt. %, based on the metal, are disclosed as being effective for hydrocracking purposes. Hydrocracking conditions include temperatures of 650° to 900° F., pressures of 500 to 10,000 psig and flow rates of 0.01 to 15 LHSV. All of these patents are concerned with homogeneous catalysis wherein the catalyst material is either oil-soluble or dispersible in the oil in finely divided form. In all of these prior art processes, effective concentrations of the homogeneous catalysts are at least 0.1 wt. %, based on the metal, or in excess of about 2.5 wt. %, based on the metal salt. Because these metal organic salts are often expensive and their use in high concentrations can affect the economic attractiveness of a process, hydroconversion processes utilizing trace amounts of homogeneous catalyst may be commercially attractive.

SUMMARY OF THE INVENTION

This invention is directed to the use of small quantities of Group VIB metal salts of organic fatty acids to catalyze the hydroconversion of petroleum oils having an intitial boiling point above 1,000° F. More particularly, the hydroconversion is effected by employing the metal salt in a concentration of about 300 to 1,000 ppm, calculated as the elemental metal. The products obtained include an oil fraction boiling below the heavy oil feed and having a sulfur concentration below that of the feed. A tar fraction is also obtained which has a higher sulfur concentration than the feed and contains a significant portion of the metal salt catalyst. A particularly preferred metal salt is molybdenum octoate.

DESCRIPTION OF THE PREFERRED EMBODIMENTS

I have found that low concentrations of metal organic salts can be employed in the hydroconversion of sulfur-containing heavy petroleum oils to produce lower boiling fractions having a sulfur concentration below that of the feed and a tar fraction having a higher sulfur concentration than the feed. The soluble metal salt catalyst is preferentially concentrated in the tar product which can be recycled for use in catalyzing the hydroconversion of additional fresh feed.

Initially, my invention is directed to a process for the catalytic hydroconversion of a sulfur-containing petroleum oil having an initial boiling point above 1,000° F. which comprises:

(a) admixing a petroleum oil having an initial boiling point above 1,000° F. with a Group VIB metal salt of a $C_7$–$C_{32}$ fatty acid, the concentration in the oil of the metal salt, calculated as the elemental metal, being below about 1,000 ppm, (b) reacting the resultant mixture with hydrogen under hydroconversion conditions, and (c) recovering from the reaction mixture of step (b), (1) an oil fraction having a lower boiling range and a lower sulfur concentration than said petroleum oil and (2) a tar fraction having a higher sulfur concentration than said petroleum oil and containing a significant portion of said metal salt.

Heterogeneous hydrodesulfurization catalysts often undergo rapid deactivation when used in processing heavy residual oils requiring constant replacement and/or regeneration. Oil-soluble metal organic compounds offer an attractive alternative. However, the prior art indicates that concentrations of these soluble catalysts of at least 0.1 wt. %, based on the metal, are necessary to effectively catalyze the hydroconversion. I have discovered that effective hydrotreatments of heavy residual oils can be made with catalyst concentrations significantly below 0.1 wt. %, calculated as the metal.

Useful feedstocks which may be employed in my process include petroleum oils having an initial boiling point above 1,000° F. and include such heavy hydrocarbon materials as atmospheric tower bottoms, vacuum tower bottoms, crude oil residuum, topped crude, tar sand oil extracts and other heavy fractions well known in the art. Properties of these useful feedstocks include an API gravity of 9° to 15° at 60° F., a carbon residue ranging from about 10 to 20 wt. % and a sulfur content from about 3 to 6 wt. %.

This process converts heavy petroleum oils into lower boiling and more useful fractions and a tar fraction. The lower boiling liquid product can be fractionated to yield naphtha, kerosene, heavy gas oil and heavy residual oil. The heavy gas oil is the principal product and may serve as feed to a fluid catalytic cracking unit. The tar fraction contains substantial quantities of the metal salt catalyst and can be combined with the fresh heavy petroleum oil feed to reduce the catalyst requirements. Excess tar can be sent to a coking unit to recover the metal. The liquid product usually has a boiling range substantially below that of the feed and often 90 to 95 vol. % of the liquid product boils below the IBP of the feed.

The metal organic salts which may be employed to catalyze this hydroconversion are the Group VIB metal salts of fatty acids. Useful acids include the $C_7$ to $C_{32}$ fatty acids with the $C_7$ to $C_{12}$ fatty acids being preferred. Examples of the useful acids include heptanoic, octanoic, nonanoic, decanoic and dodecanoic acids, as well as myristic, palmitic, stearic, oleic, linoleic and melissic acids. Among the Group VIB metals, I find that the molybdenum and tungsten fatty acid salts are preferred, with one, molybdenum octoate, being especially preferred. I find that the metal salt catalyst is effective if present in concentrations of 300 to 3,000 ppm, based on the elemental metal, although concentrations below 0.1 wt. % based on the metal, i.e., below about 1,000 ppm, are preferred, with a range of between about 300 to 1,000 ppm being particularly preferred and a concentration of between about 500 and 1,000 ppm being especially preferred. I find that hydroconversion conditions need not be as severe as those employed in hydrocracking to effect desirable results. Thus, a temperature range of about 750 to 900° F., a pressure of 1,500 to 2,500 psig and a residence time of 0.1 to 10 hours may be employed. Hydrogen is added to the reaction and I find that hydrogen consumption is usually between about 1,000 and 2,500 SCF/B of feed.

My process may be conducted in any of the equipment normally employed in catalytic hydroconversion of petroleum oils. This equipment is well known in the art. For example, the fresh feed may be combined with the required quantity of metal salt catalyst, passed through a furnace to achieve proper reaction temperature and passed into a vessel, for example, a packed tower, where the mixture is combined with required quantities of hydrogen to effect the hydroconversion. The resultant mixture passes from the tower to a separation vessel where excess hydrogen is removed for recycle and a tar fraction is recovered. The liquid product may then be fractionated to produce dry gas, naphtha, kerosene, gas oil (the principal product), and a heavy residual oil. Since the tar fraction contains substantial quantities of the metal salt catalyst, it is recycled and combined with the fresh feed, and only a small quantity of make-up catalyst is required. The heavy residual oil recovered may also be recycled.

The following examples exemplify the practice of this invention.

EXAMPLE I

A number of metal organic compounds were evaluated in a batch autoclave employing, as a feed, a 1,000° F. plus reduced Arabian crude, described in Table I below:

TABLE I

| Feedstock | Reduced Arabian Crude |
|---|---|
| Gravity, API | 7.5 |
| Carbon Residue, wt. % | 20.69 |
| Nitrogen, wt. % | 0.31 |
| Sulfur, wt. % (X-ray) | 4.0 |
| Asphaltenes, wt. % | 8.22 |
| Metals, ppm | |
| Fe | 6 |
| Ni | 11 |
| V | 43 |
| DPI Flask Distillation, ° F, wt. % | |
| IBP-850° F | 0 |
| 850° F+ | 100 |

In a typical run, the autoclave was charged with 500 to 600 grams of 1,000° F. plus reduced Arabian crude and a sufficient quantity of the metal organic compound under study to produce the required metal concentration. The autoclave was closed, pressured with hydrogen to about 2,000 psig and maintained at that pressure and at a temperature of approximately 800° F. for eight hours. Activity of the material under study was measured by the uptake of hydrogen and the absence of coke in the product oil. The results of this series of runs are shown in Table II below:

TABLE II

| Run No. | Metal Organic Material Tested | Catalyst Concentration ppm (metal) | Activity |
|---|---|---|---|
| 1 | Chromium Acetylacetonate | 1000 | None |
| 2 | Cobalt Octoate | 1000 | None |
| 3 | Ferric Octoate | 1000 | None |
| 4 | Vanadium Acetylacetonate | 1000 | None |
| 5 | Zinc Naphthenate | 1000 | None |
| 6 | Titanium Ester | 1000 | None |
| 7 | Manganese Naphthenate | 1000 | None |
| 8 | Molybdenum Octoate | 1180 | Good |
| 9 | Molybdenum Octoate | 590 | Good |
| 10 | Molybdenum Octoate | 300 | Good |
| 11 | Molybdenum Octoate | 60 | None |

The above runs show that, although all of the organic materials tested had a common property in that the metal atom was joined to the organic portion of the compound through an oxygen atom, not all of these materials were effective hydroconversion catalysts at these low concentrations. The metals tested included some from Groups IIB, IVB, VB, VIB, VIIB and VIII, while the organic portion of the compounds included 1,3 diketones, fatty acids, naphthenic acids and alcohols. These runs demonstrated that the useful materials must be a combination of a Group VIB metal and a fatty acid (Runs 8–10). A group VIB metal with a 1,3 diketone was ineffective (Run 1), as were Group VIII metals together with a fatty acid (Runs 2 and 3). Other metal-containing organic materials were also ineffective catalysts (Runs 4–7). Further, Runs 8 to 11 show that molybdenum octoate, a Group VIB salt of a fatty acid, was an effective hydroconversion catalyst at concentrations between 300 and 1,180 ppm, while at 60 ppm it did not promote the hydroconversion. In all runs where the activity was good it was discovered at the end of the run that the charge had been converted into an oil fraction and a tar fraction, while in those runs where there was no activity an oil fraction and a coke fraction were obtained.

EXAMPLE II

In a fashion similar to that of the procedure of Example I, two runs were made in the batch autoclave to compare the products obtained when a Group VIB metal salt of octanoic acid was employed. The feedstock employed was that used in Example I having a sulfur content of 4.0% and an API gravity of 7.5. In Run 12, molybdenum octoate was added to the feed charge, while in Run No. 13 no additions of metal compound were made. In each instance the operating conditions included a temperature of 800° F., a hydrogen pressure of 2,000 psig and a test period of eight hours.

The molybdenum content in Run 12 was 590 ppm. In Run No. 12 the reduced crude was converted to an oil product and a tar fraction, while in Run No. 13, wherein no metal octoate was employed, the products were an oil fraction and coke. The results are set forth in Table III below:

TABLE III

HYDROTREATING WITH AND WITHOUT MOLYBDENUMOCTOATE CATALYST

| | | Run No. 12 | | Run No. 13 |
|---|---|---|---|---|
| Mo Content in Charge | | 590 | | None |
| $H_2$ Absorption, SCF/B | | ca. 2100 | | None |
| Recoveries, wt.% | | | | |
| $H_2S$ | | 1.2 | | |
| $C_1$-$C_3$ | | 9.9 | | 18.0 |
| $C_4$-$C_5$ | | 2.1 | | |
| Oil | | 65.0 | | 44.0 |
| Residue | | . Tar - 19.0 | Coke - | 38.0 |
| Total Recovery | | 97.2 | | 100.0 |
| Oil Tests | Feed | | | |
| Sulfur, wt. % | 4.0 | 1.8 | | 1.4 |
| Nitrogen, wt. % | 0.31 | — | | 0.11 |
| Carbon Residue, wt. % | 20.69 | 5.91 | | — |
| Gravity, API | 7.5 | 29.8 | | 40.9 |
| Metals, ppm | | <5 | | <5 |
| DPI Flask Distillation, wt. % | | | | |
| IBP–350° F | | 23.0 | | |
| 350–550° F | | 26.0 | | |
| 550–1000° F | | 41.0 | | |
| 1000° F+ | | 9.0 | | |
| Residue | | Tar | | Coke |
| Solubility in Benzene | | Soluble | | Insoluble |
| Sulfur, wt. % | | 4.75 | | — |
| Mo, ppm | | 1700 | | — |

Runs 12 and 13 show the effectiveness of the subject invention and Run 12, in particular, shows the production of a lighter oil fraction having a reduced sulfur content and a tar fraction containing substantial quantities of the molybdenum catalyst. Significantly, more than 90 wt. % of the oil product boiled below the IBP of the feed.

These examples demonstarate the effectiveness of employing small quantities of Group VIB metal salts of fatty acids in the hydrotreating of heavy petroleum oils.

Obviously, many modifications and variations of my invention as hereinbefore set forth may be made without departing from the spirit and scope thereof. Therefore, only such limitations should be imposed as are indicated in the following claims.

I claim:

1. A process for the catalytic hydroconversion of a sulfur-containing petroleum oil having an initial boiling point above 1,000° F. which comprises:

(a) admixing a petroleum oil having an initial boiling point above 1,000° F. with a metal salt consisting essentially of a Group VIB metal salt of a $C_7$ to $C_{32}$ fatty acid, the concentration in the oil of the metal salt, calculated as the elemental metal, being below about 1,000 ppm, (b) reacting the resultant mixture with hydrogen under hydroconversion conditions comprising a temperature of between about 750° and 900° F., a hydrogen pressure of between about 1,500 and 2,500 psig and a reaction time of between about 0.1 and 10 hours, and (c) recovering from the reaction mixture of step (b), (1) an oil fraction having a lower boiling range and a lower sulfur concentration than said petroleum oil and (2) a tar fraction having a higher sulfur concentration than said petroleum oil and containing a significant portion of said metal salt.

2. A process according to claim 1 wherein the metal salt is of a $C_7$ to $C_{12}$ fatty acid.

3. A process according to claim 1 wherein the Group VIB metal is chromium.

4. A process according to claim 1 wherein the Group VIB metal is molybdenum.

5. A process according to claim 1 wherein the Group VIB metal is tungsten.

6. A process according to claim 4 wherein the metal salt is molybdenum octoate.

7. A process according to claim 1 wherein the concentration of the metal salt is between about 300 and 1,000 ppm, calculated as the elemental metal.

8. A process according to claim 1 wherein the concentration of the metal salt is between about 500 and 1,000 ppm, calculated as the elemental metal.

9. A process according to claim 1 wherein the petroleum oil has an API gravity of between 9° and 15°, a carbon residue of about 10 to 20 wt. % and a sulfur content of about 3 to 6 wt. %.

10. A process for the catalytic hydroconversion of a sulfur-containing petroleum oil having an initial boiling point above 1000° F. which comprises:

(a) admixing a petroleum oil having an initial boiling point above 1000° F. with (1) a metal salt consisting essentially of a Group VIB metal salt of a $C_7$ to $C_{32}$ fatty acid and (2) a portion of the tar fraction recovered in step (c) hereinafter, the concentration in the resultant mixture of the metal salt, calculated as the elemental metal being below about 1000 ppm, (b) reacting the resultant mixture with hydrogen under hydroconversion conditions comprising a temperature of between about 750° and 900° F., a hydrogen pressure of between about 1,5000 and 2,500 psig and a reaction time of between about 0.1 and 10 hours, and (c) recovering from the reaction mixture of step (b), (1) an oil fraction having a lower boiling range and a lower sulfur concentration than said petroleum oil and (2) a tar fraction having a higher sulfur concentration than said petroleum oil and containing a significant portion of said metal salt.

11. A process according to claim 10 wherein a portion of the tar fraction of step (c) is passed into a coking zone whereby the metal is recovered.

* * * * *